US007210421B1

(12) United States Patent
Pendergraph

(10) Patent No.: US 7,210,421 B1
(45) Date of Patent: May 1, 2007

(54) LATCH SYSTEM FOR A WATERTIGHT BULKHEAD DOOR

(75) Inventor: David E. Pendergraph, Auburn, NY (US)

(73) Assignee: Performance by Design International, Inc., Auburn, NY (US)

( * ) Notice: Subject to any disclaimer, the term of this patent is extended or adjusted under 35 U.S.C. 154(b) by 2 days.

(21) Appl. No.: 11/218,176

(22) Filed: Sep. 1, 2005

Related U.S. Application Data

(60) Provisional application No. 60/607,019, filed on Sep. 3, 2004.

(51) Int. Cl.
*B63B 3/56* (2006.01)

(52) U.S. Cl. ..... 114/78

(58) Field of Classification Search ..... 114/78
See application file for complete search history.

(56) References Cited

U.S. PATENT DOCUMENTS 2,151,154 A * 3/1939 Roethel ..... 292/341.13
2,210,989 A * 8/1940 Sutherland ..... 292/49
6,341,450 B1 * 1/2002 Macander et al. ..... 52/20

* cited by examiner

*Primary Examiner*—Stephen Avila
(74) *Attorney, Agent, or Firm*—Neal L. Slifkin; Robert C. Brown

(57) ABSTRACT

A latch system for a watertight bulkhead door for closing a bulkhead opening. A plurality of surrounding shield elements are translated by an articulated mechanism into and out of locking engagement with the bulkhead door. A continuous wedged striker along the periphery of the door surface is engaged by wedged surfaces on the shield elements when the shield elements are translated into locking relationship with the door, causing a gasket in the door to be compressed against a collar surrounding the bulkhead opening. The shield elements abut each other in closed position, forming a continuous frame around the door to shield the gasket from fire and to provide a small radar cross-section. Preferably, the exterior shield elements are mounted to a prior art articulated dogging mechanism disposed on the interior of the bulkhead. A plurality of translatable inner bulkhead shields is also provided to cover the articulated mechanism for safety.

14 Claims, 8 Drawing Sheets

LATCH SYSTEM FOR A WATERTIGHT BULKHEAD DOOR

The present application draws priority from a pending U.S. Provisional Patent Application Ser. No. 60/607,019, filed Sep. 3, 2004.

TECHNICAL FIELD

The present invention relates to doors for naval bulkheads; more particularly, to latching mechanisms for watertight sealing of doors in naval bulkheads; and most particularly, to a novel latching mechanism for a bulkhead door that provides consistent lockdown tension, improves fire resistance for a sealing gasket, and eliminates the use of exposed metal latching dogs, thus improving radar cross-section.

BACKGROUND OF THE INVENTION

Watertight bulkhead doors are well known on naval vessels. As used herein, "bulkhead door" should be taken to mean a sealable door installed in a vertical surface (bulkhead door), a horizontal surface ("hatch cover"), or a door-within-a-door ("scuttle"). A typical prior art bulkhead door includes a resilient gasket that mates with an edge of a collar surrounding a bulkhead opening and extending from the bulkhead outer surface. A plurality of pivotable latches, known in the art as "dogs", are mounted on the bulkhead and may be pivoted into position against the outer surface of the door where they progressively engage wedged areas, known in the art as "strikers". Such progressive rotational engagement causes the gasket to be compressed against the collar, sealing the bulkhead opening against water and/or gas transmission.

In some prior art embodiments, the dog spindles extend pivotably through the bulkhead and are mechanically linked around the interior of the bulkhead opening such that actuation of a master handle, extending pivotably through the bulkhead and actuable from either side thereof, causes all the dogs to be engaged or disengaged synchronously.

Prior art bulkhead door systems employing exposed metal dogs create an undesirably enhanced radar cross-section, to the benefit of an enemy combatant in naval warfare.

Further, prior art doors typically are formed by stamping from sheet metal and include a stamped relief pattern to enhance flexural rigidity. It has been found that such a pattern is highly undesirable, for two reasons: first, the pattern greatly increases radar reflection from the door; and second, the pattern is difficult to wash down easily and thoroughly as may be required for washdown of a chemical spill or biochemical attack. For these considerations, a smooth surface is preferred.

The gasket of a prior art door system is relatively exposed to damage by fire on the exterior of the bulkhead, resulting in failure of the watertight and gastight seal.

Use of a plurality of spaced-apart dogs results in inconsistent lockdown pressure across the door such that under extreme pressure conditions the door may become distorted and leakage may occur between adjacent dog positions, especially when the door is formed of a non-metal polymeric composite.

What is needed in the art is an improved latching system for a bulkhead door that eliminates exposed metal dogs on the exterior of the door, provides consistent lockdown pressure across the door, permits easy and thorough washdown from a chemical spill or biological attack, and shields the door gasket from attack by fire.

It is a principal object of the present invention to provide a uniform lockdown pressure at all points of a bulkhead door gasket.

It is a further object of the invention to reduce the radar cross-section of a bulkhead door assembly.

It is a still further object of the invention to protect a bulkhead door gasket from exposure to fire.

It is a still further object of the invention to facilitate easy, rapid, and thorough cleanup of a chemical spill or a biological attack.

It is a still further object of the invention to utilize existing bulkhead openings and door actuation mechanisms.

SUMMARY OF THE INVENTION

Briefly described, a latch system for a watertight bulkhead door for closing a bulkhead opening comprises a plurality of shield elements that may be translated by an articulated mechanism into and out of locking engagement with the bulkhead door. The door is provided with a first elongate continuous wedged striker surface along the periphery of the outer door surface, and the shield elements are provided with second elongate wedged surfaces for mating with the first wedged surface when the shield elements are translated into locking relationship with the door. Such wedged mating causes a resilient gasket mounted in a flange of the door to be compressed against an edge of a collar surrounding the bulkhead opening. The exterior shield elements abut each other in closed position, forming a continuous frame around and over the periphery of the door, thereby shielding the gasket from ready attack by fire and providing a small radar cross-section. Preferably, the exterior shield elements are mounted to a modified prior art articulated mechanism disposed on the interior of the bulkhead and surrounding the bulkhead opening. Preferably, a plurality of translatable inner bulkhead shields is also provided to cover the articulated mechanism during actuation thereof for reasons of personnel safety.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
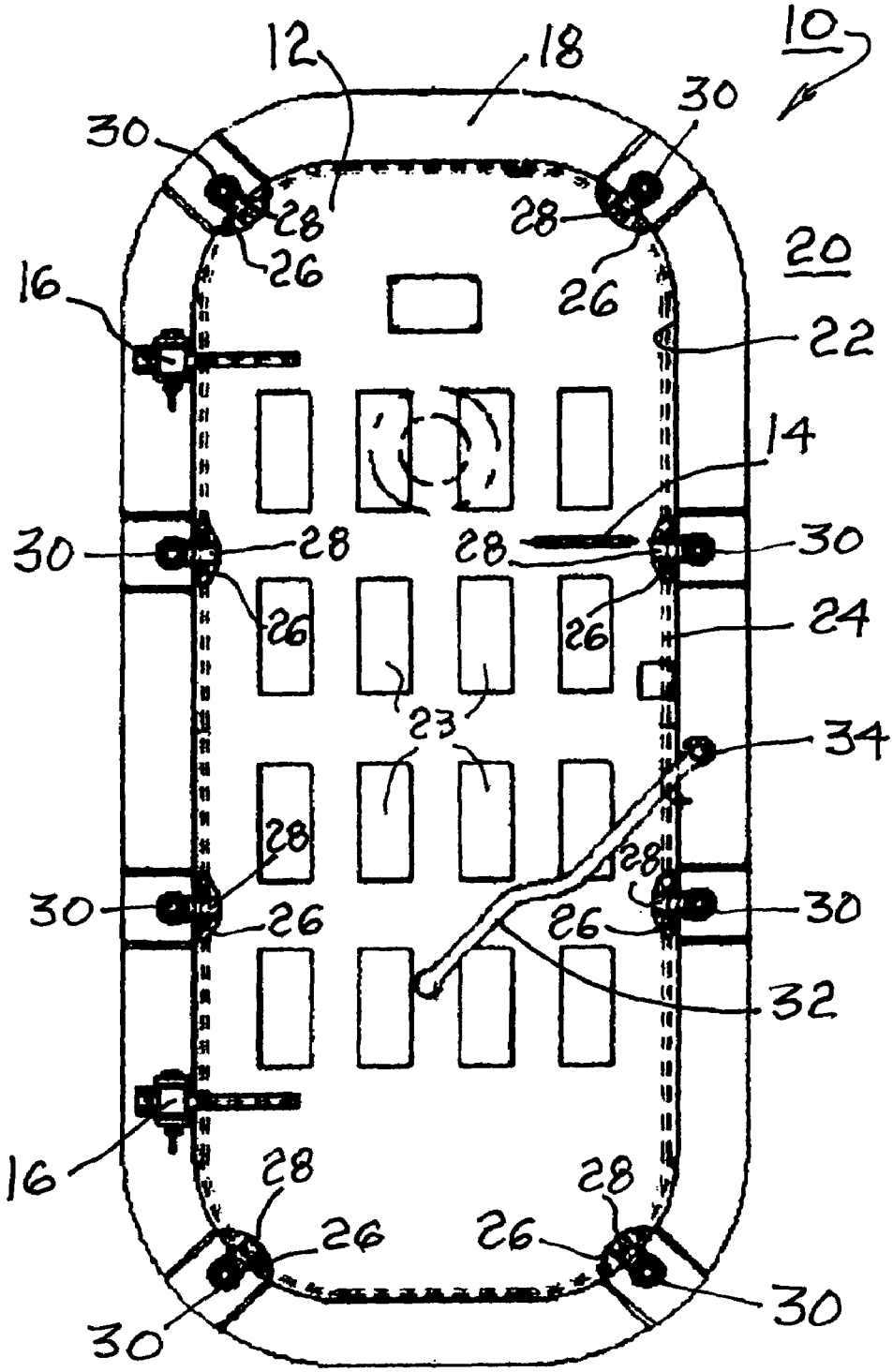
FIG. 1 (PRIOR ART)
FIG. 1 is an elevational exterior view of a prior art watertight bulkhead door, showing a plurality of pivotable dogs for securing the door against a collar surrounding a bulkhead opening.

Referring to FIG. 1, a prior art watertight bulkhead door system 10 comprises a bulkhead door 12 provided with a handle 14 and hinges 16 mounted to a collar 18 attached to an exterior surface of a bulkhead 20 and surrounding a bulkhead opening 22. Prior art door 12 includes a pattern of stampings 23 to increase flexural rigidity and a continuous peripheral gasket 24 disposed on a reverse side of door 12 for sealingly mating with a collar 18 extending away from the exterior bulkhead surface. System 10 is shown in door closed and locked position.

The peripheral surface of door 12 is provided with a plurality of strikers 26 tapered in a direction generally parallel with the sides of door 12. An equal number of dogs 28 are pivotably disposed, one for each striker, outboard of door 12 in collar 18. Dogs 28 are mounted on spindles 30 extending through collar 18 and bulkhead 20, the spindles being synchronously rotatable by an articulated mechanism (not visible in FIG. 1) surrounding opening 22 on the interior of bulkhead 20. The mechanism comprises a linkage of spindles, connecting rods, and bellcranks, manually actuable by a master lever 32 mounted on a pivotable spindle 34 extending through collar 18 and bulkhead 20 as a component of the articulated mechanism. Lever 32 has a counterpart (not visible) on the interior of bulkhead 20.

In operation of prior art system 10, starting in an open position, rotation of lever 32 in a first direction causes dogs 28 to be rotated on their individual spindles 30 into overlapping relationship with strikers 26 whereby each dog 28 engages the wedged surface of its respective striker 26. Continued rotation of dogs 28 on the striker wedged surfaces urges door 12 toward bulkhead 20, causing the gasket to be compressed against the collar flange. Opening of system 10 is the reverse of closing.

Figure 2:
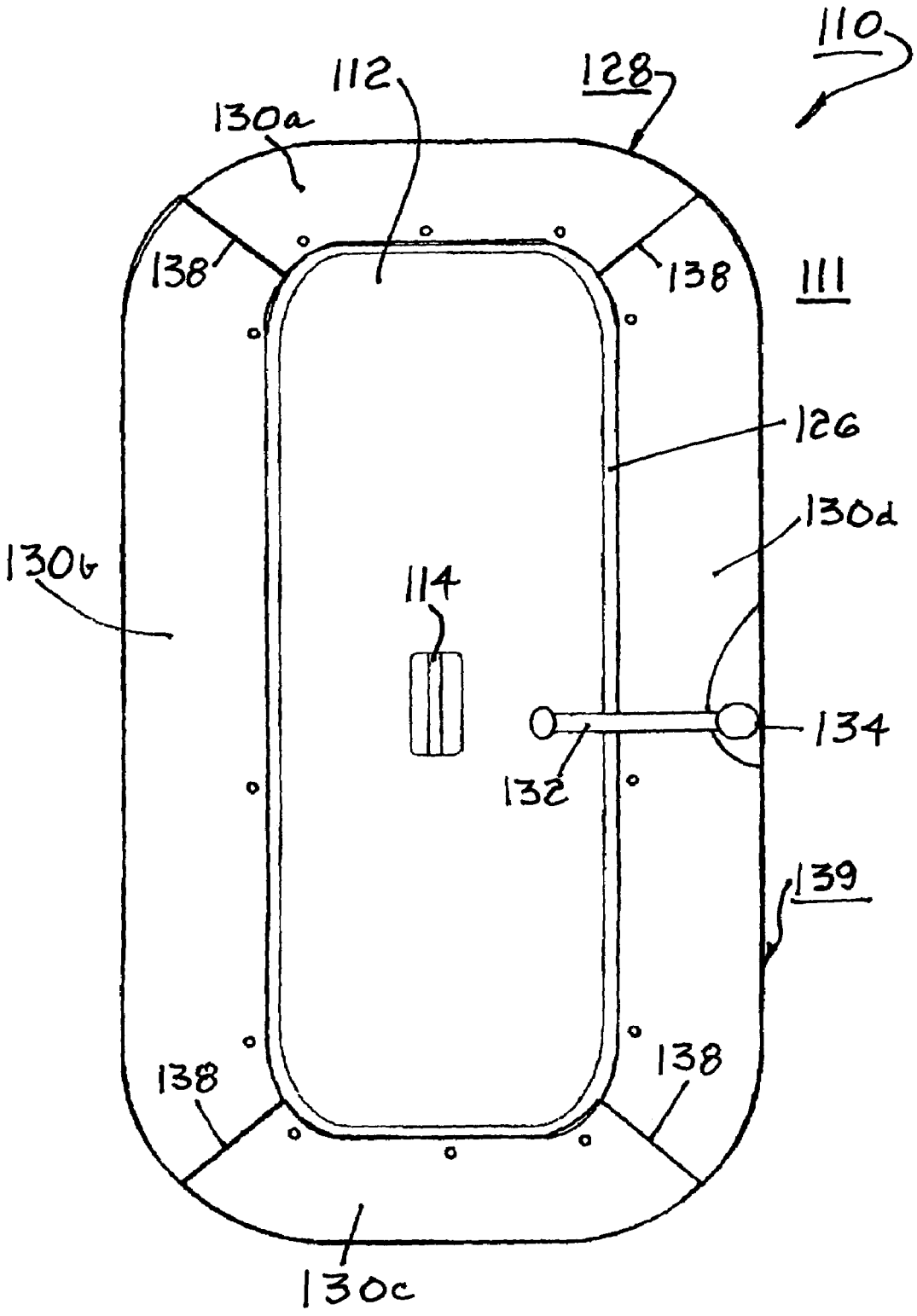
FIG. 2 is an elevational exterior view of a watertight bulkhead door having a latch system in accordance with the invention, showing the latch system in locked position.
Figure 3:
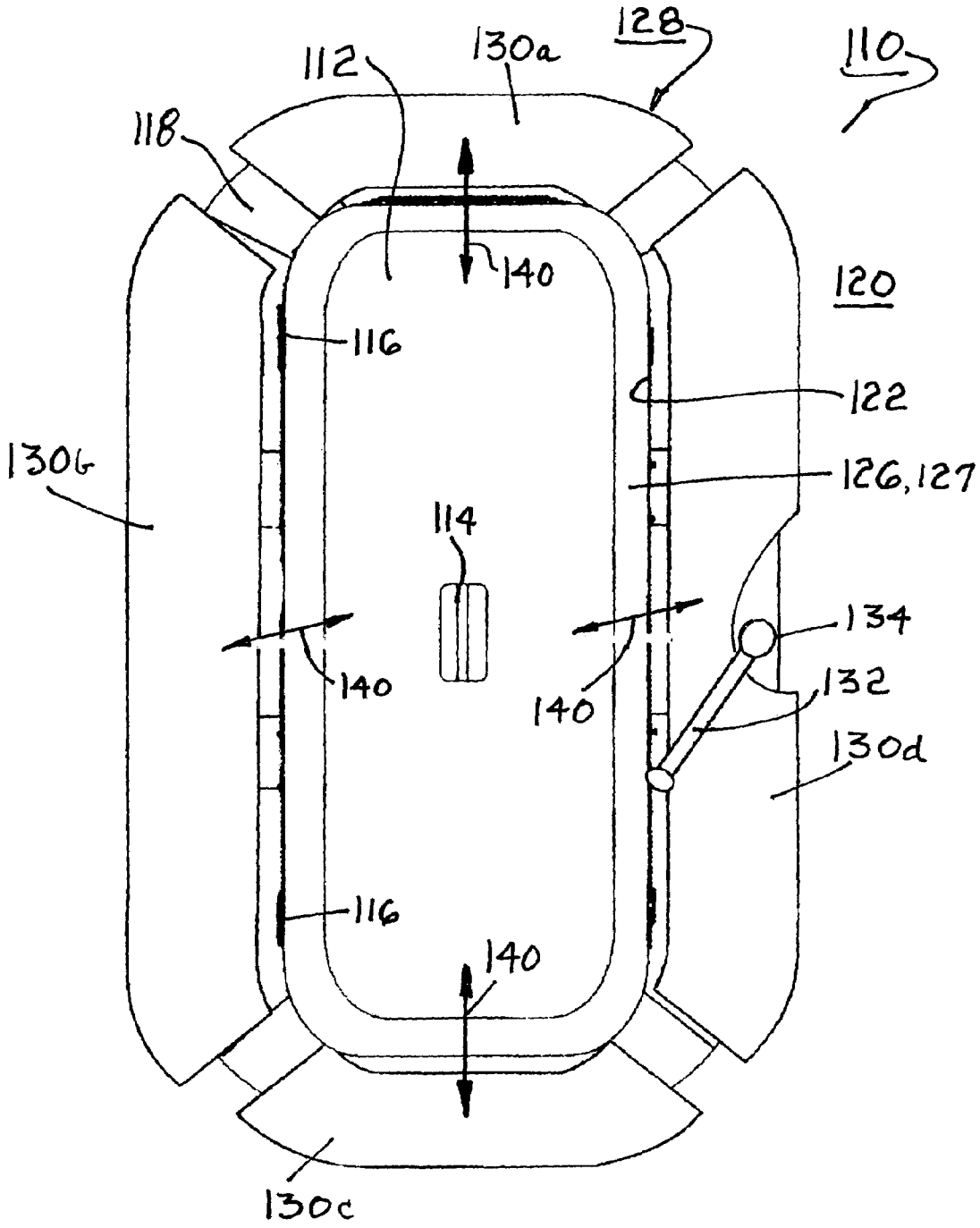
FIG. 3 is a view like that shown in FIG. 2, showing the latch system in open position.
Figure 4:
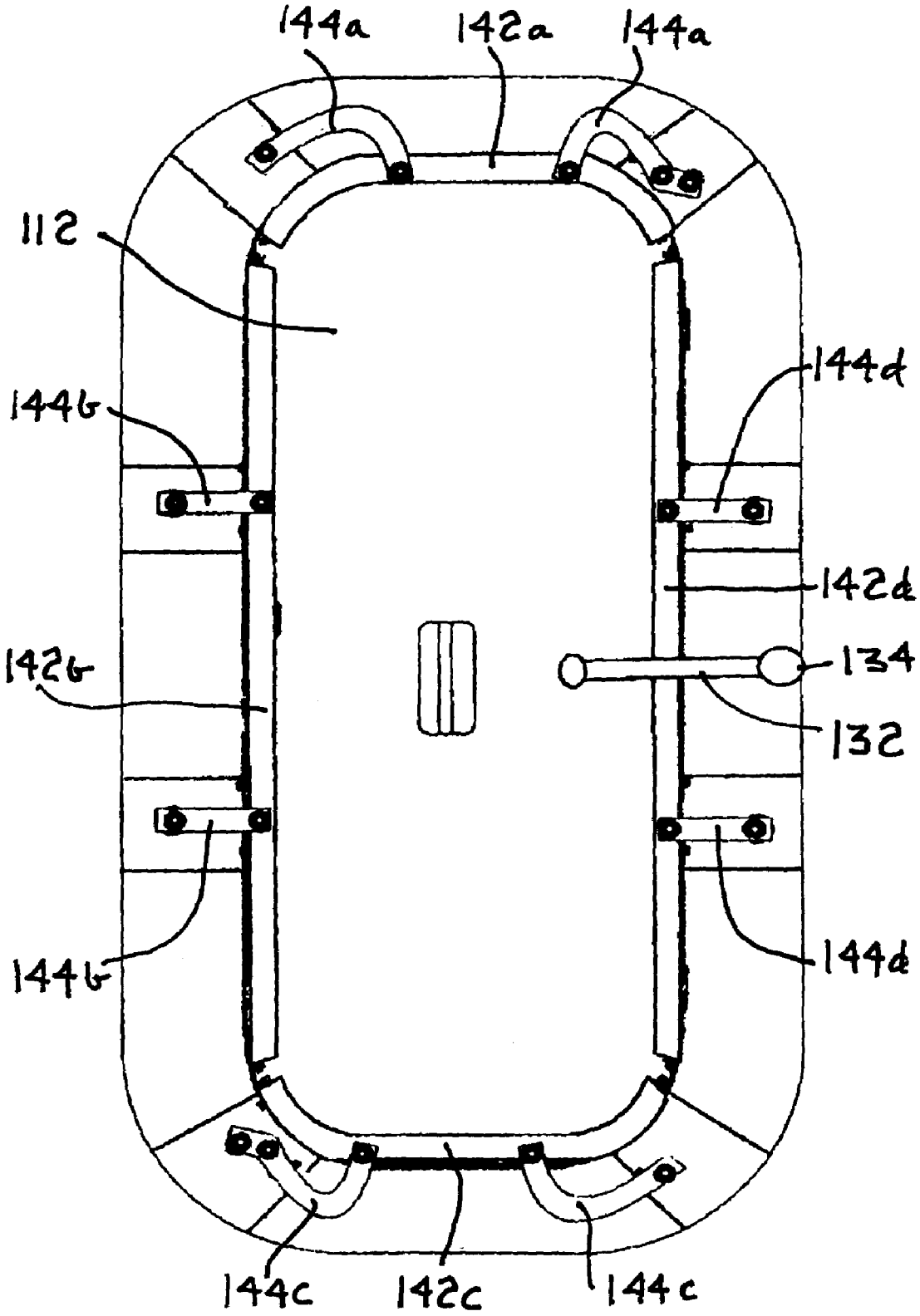
FIG. 4 is a view like that shown in FIG. 2, having the exterior shields removed for clarity to show the latching wedges in locked position.
Figure 5:
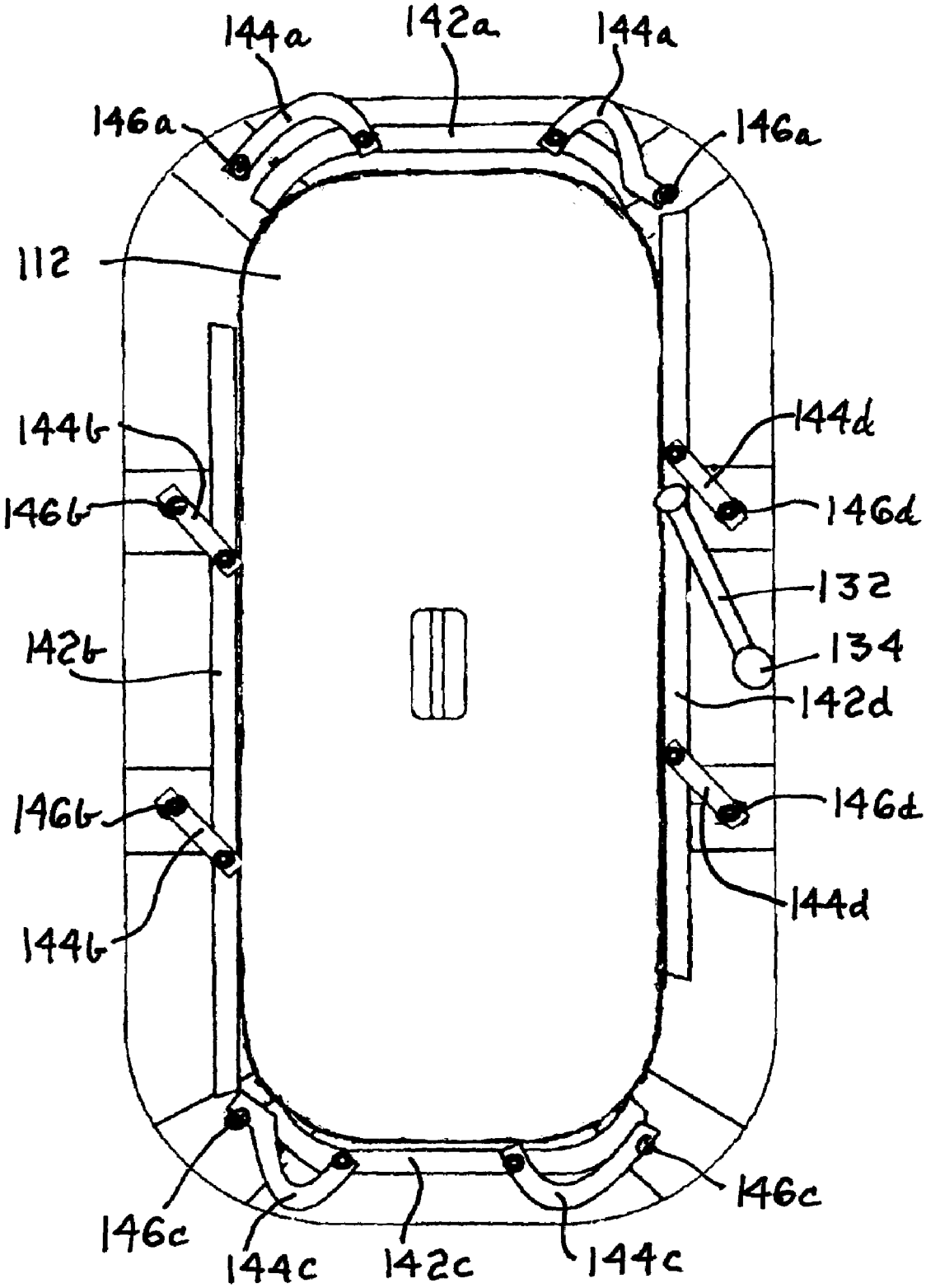
FIG. 5 is a view like that shown in FIG. 4, showing the latching wedges in open position.
Figure 6:
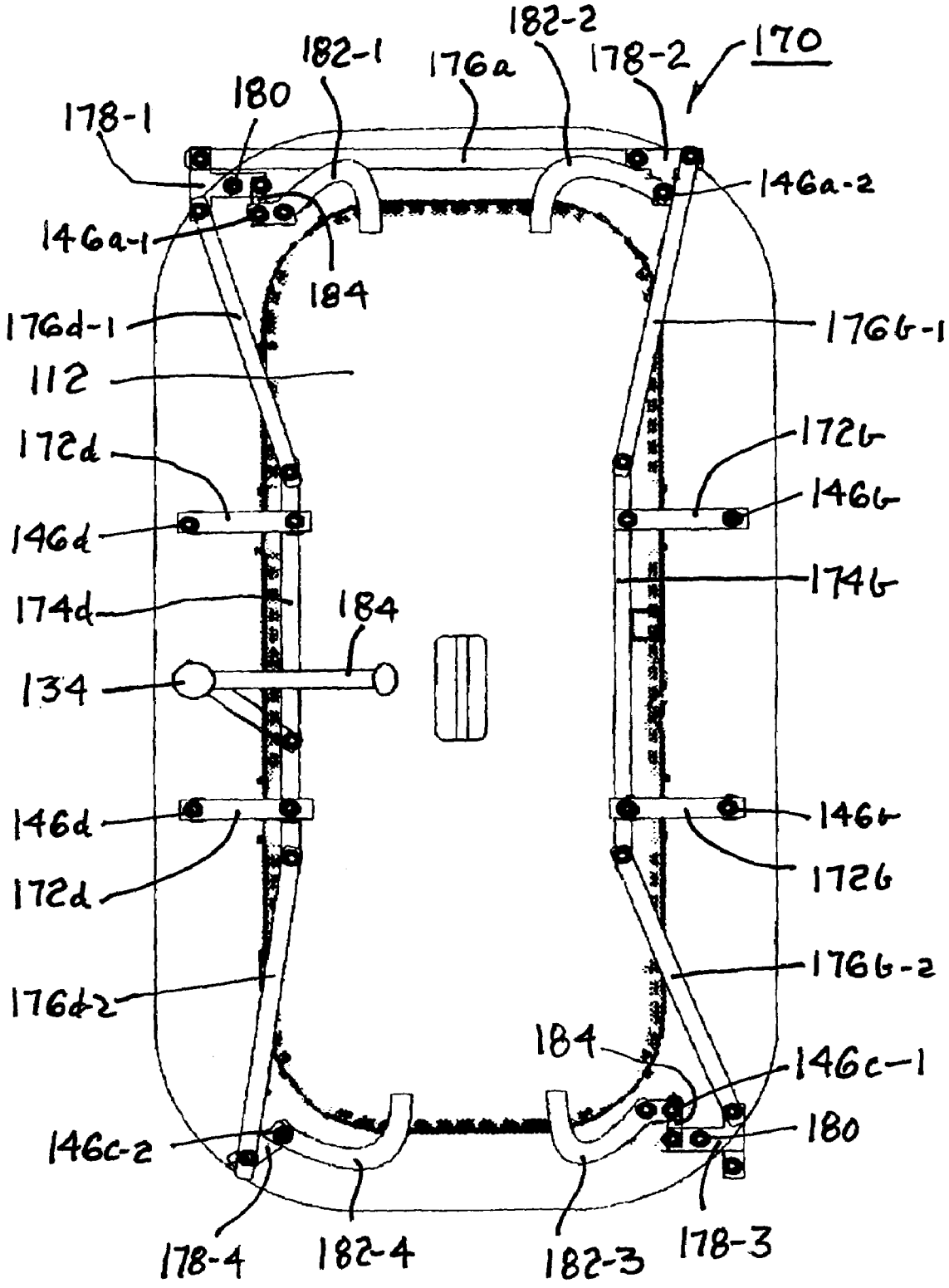
FIG. 6 is an elevational interior view of the door and latch system shown in FIG. 2, having the interior shields removed for clarity to show the articulated mechanism in locked position.
Figure 7:
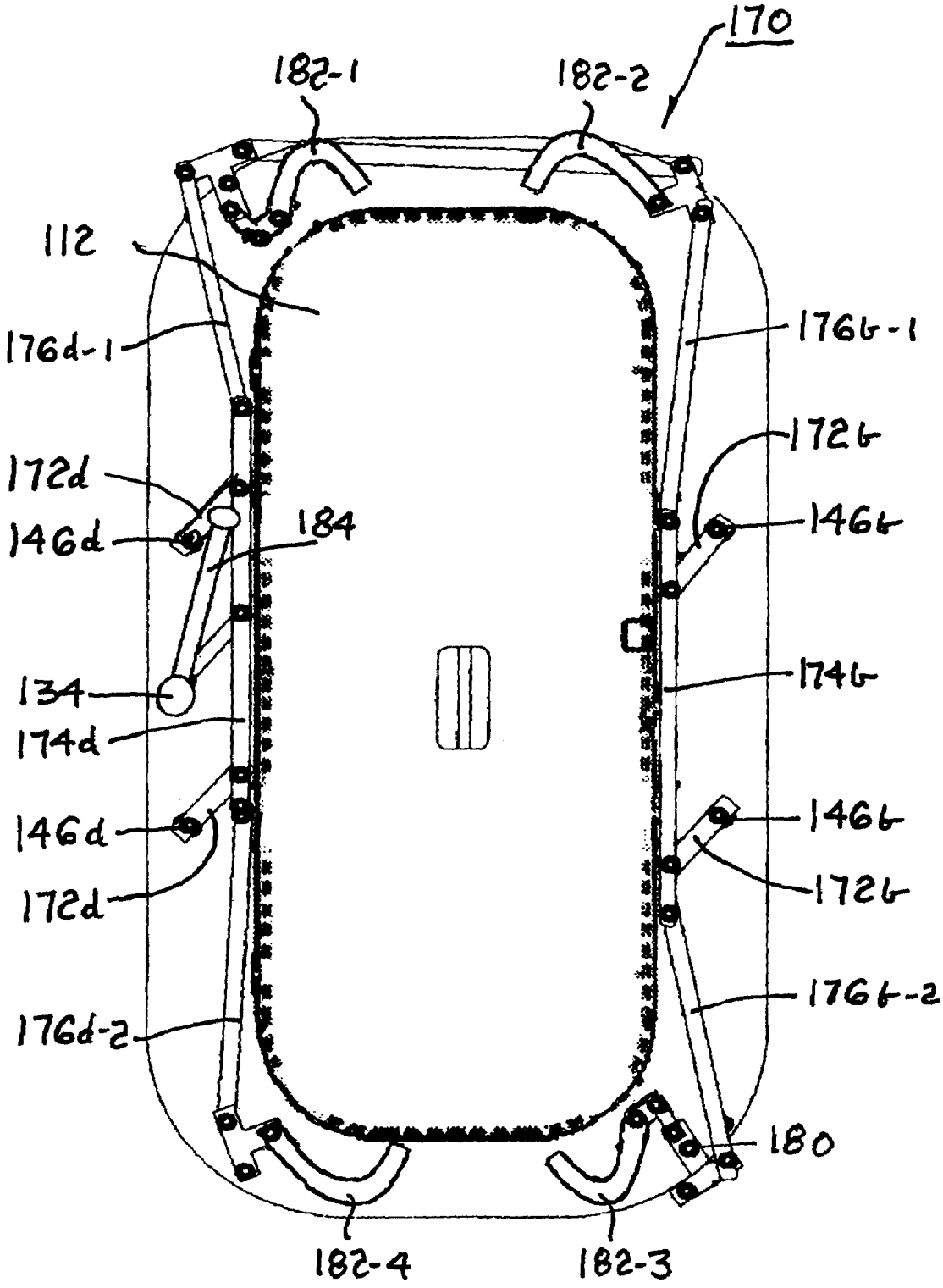
FIG. 7 is a view like that shown in FIG. 6, showing the articulated mechanism in open position.

Referring to FIGS. 2 and 3, a watertight bulkhead door latching system 110 in accordance with the invention for a vessel 111 comprises a bulkhead door 112 provided with a handle 114 and hinges 116 mounted to a collar 118 attached to an exterior surface of a bulkhead 120 and surrounding a bulkhead opening 122. Door 112 includes a continuous peripheral gasket (not visible in FIGS. 2 and 3 but described fully below) disposed on a reverse side of door 112 for sealingly mating with a collar flange extending away from the exterior bulkhead surface.

The peripheral surface of door 112 is provided with an elongate striker 126, preferably continuous around the periphery of door 112 and having a surface 127 tapered in a direction generally orthogonal to the sides of door 112. A translatable exterior shield assembly 128 comprising a plurality of individually translatable shield elements, preferably numbering four 130*a*,130*b*,130*c*,130*d*, is disposed on an articulated mechanism (not visible in FIGS. 2 and 3 but described fully below in respect of FIGS. 4 through 9) outboard of door 112 in collar 118. The mechanism comprises a linkage of spindles, connecting rods, and bellcranks, and is manually actuable by a master actuating lever 132 mounted on a pivotable spindle 134 extending through collar 118 and bulkhead 120 as a component of the articulated mechanism. Lever 132 has a counterpart (not visible) on the interior of bulkhead 120, as discussed below.

Figure 9:
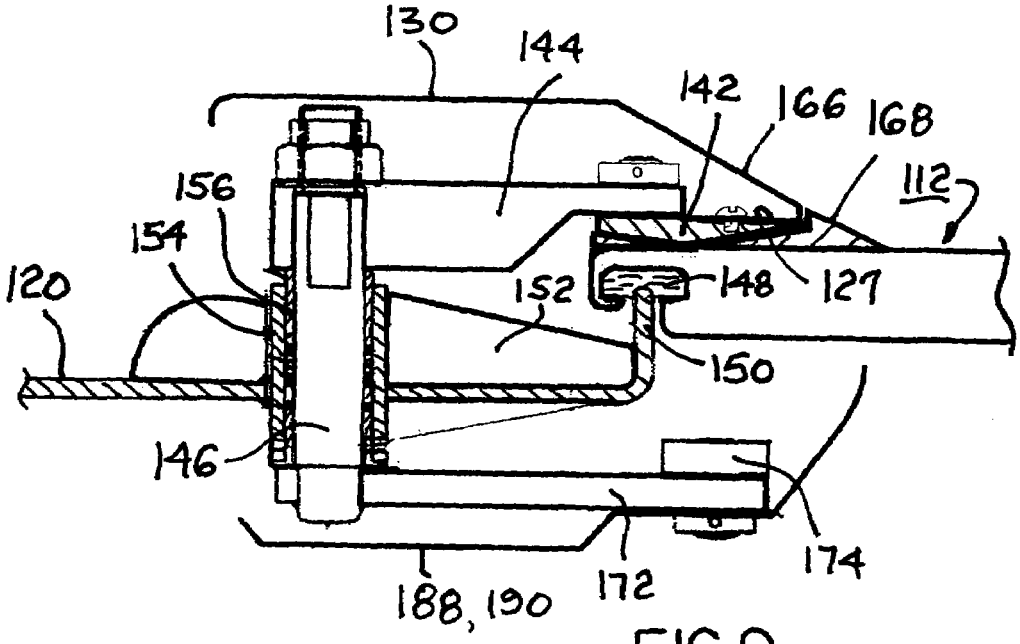
FIG. 9 is a view like that shown in FIG. 8, showing the system in locked position.

In locked position, as shown in FIGS. 2 and 9, exterior shield elements 130 including locking wedge elements 142 have been translated into an overlapped relationship with wedged striker surface 127 as described below to urge door 112 toward bulkhead 120, thus compressing the gasket against the collar flange to seal the bulkhead door over the bulkhead opening. Further, exterior shield elements 130 closely abut each other at junctures 138 to form a substantially continuous exterior frame 139 around the periphery of door 112.

In open position (FIG. 3), exterior shield elements 130 are retracted from overlap with door 112 in respective directions 140 away from door 112, permitting the door to be opened outwards on its hinges 116.

In a currently preferred embodiment, bulkhead door 112 comprises outer and inner shells 113,115 formed of material composites and bonded together.

Referring to FIGS. 2–5, 8, and 9, exterior shield assembly 128 comprises each exterior shield element 130*a*,130*b*,130*c*, 130*d* and a corresponding locking wedge element 142*a*, 142*b*,142*c*,142*d* attached thereto and extending generally parallel to the edge of door 112 and the adjacent striker 126. Upper and lower locking wedge elements 142*a*,142*c* are pivotably mounted on curved lock lever arms 144*a*,144*c* respectively. Arms 144*a*,144*c* in turn are fixedly mounted on respective spindles 146*a*,146*c* which are pivotably extended through collar 118 and bulkhead 120 such that rotation of spindles 146*a*,146*c* causes wedge elements 142*a*,142*c* to be urged into or out of overlapping relationship with door striker 126. The wedge elements are sized such that an interference exists between wedge elements 142*a*,142*c* and striker surface 127 which is relieved by compression of gasket 148 against collar flange 150.

Similarly, left and right locking wedge elements 142*b*, 142*d* are pivotably mounted on lock lever arms 144*b*,144*d* respectively. Arms 144*b*,144*d* in turn are fixedly mounted on respective spindles 146*b*,146*d* which are pivotably extended through collar 118 and bulkhead 120 such that rotation of spindles 146*b*,146*d* causes wedge elements 142*b*,142*d* to be urged into or out of overlapping relationship with door striker 126, causing compression of gasket 148 against collar flange 150.

Figure 8:
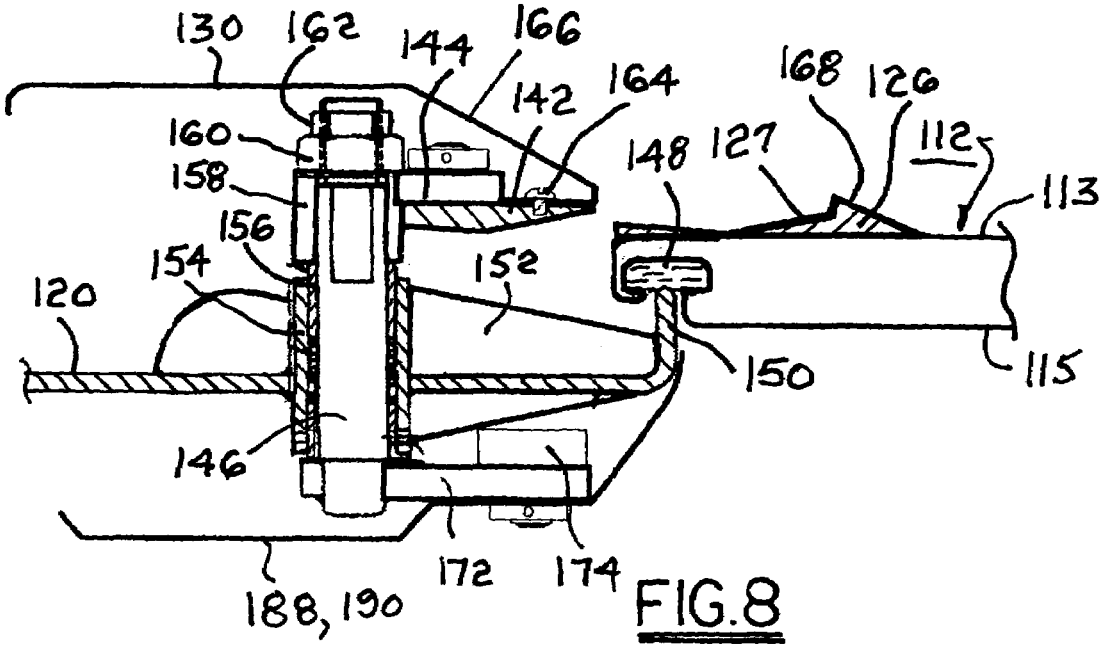
FIG. 8 is a cross-sectional view of a portion of a latch system in accordance with the invention, showing the system in open position.

Referring still to FIGS. 8 and 9, bulkhead 120 is reinforced in the regions of passage of each of spindles 146 therethrough by a frame stiffener 152 supportive of a spindle bushing 154 and sleeve 156. Spindle 146 is entered into sleeve 156 from the interior of bulkhead 120. A boss 158 on lock lever arm 144 is captured by a compression nut 160 and lock nut 162. Exterior shield element 130 is attached to locking wedge element 142 by screws 164 and is formed to cover the spindle assembly and to have a surface 166 tapered toward striker 126. Preferably, striker 126 is also provided with a tapered outer surface 168 which abuts surface 166 (FIG. 9) when system 110 is in locked position to provide a continuous radar-diverting surface having a low radar cross-section.

Referring to FIGS. 6 through 9, a bulkhead-interior mechanism 170 and operations thereof will now be discussed. Each side spindle 146*b*,146*d* is fixedly connected to a respective actuating lever arm 172*b*,172*d*. Actuating lever arms 172*b*,172*d* are connected by first and second connecting rods 174*b*,174*d* respectively. The upper ends of connecting rods 174*b*,174*d* are themselves linked by connecting rods 176*b*-1,176*d*-1 to upper bellcranks 178-1,178-2. Bellcrank 178-1 is pivotably mounted on a blind spindle 180. Bellcrank 178-2 is fixedly mounted on spindle 146*a*-2. Bellcranks 178-1,178-2 are connected by connecting rod 176*a*. First upper curved lever arm 182-1 is mounted on spindle 146*a*-1 for actuation by a linkage 184 connected to bellcrank 178-1. Second upper curved lever arm 182-2 is fixedly attached to bellcrank 178-2 for rotation therewith.

Similarly, the lower ends of connecting rods 174*b*,174*d* are themselves linked by connecting rods 176*b*-2,176*d*-2 to lower bellcranks 178-3,178-4. Bellcrank 178-3 is pivotably mounted on a blind spindle 180. Bellcrank 178-4 is fixedly mounted on spindle 146*c*-2. First lower curved lever arm 182-3 is mounted on spindle 146*c*-1 for actuation by a linkage 184 connected to bellcrank 178-3. Second lower curved lever arm 182-4 is fixedly attached to bellcrank 178-4 for rotation therewith.

A master interior actuating lever 184 is fixedly mounted on pivotable spindle 134 extending through the bulkhead and collar to a master exterior actuating lever 132 as described above. Master interior actuating lever 184 is attached to actuating lever 172*d* such that rotation of either of levers 132,184 and spindle 134 serves to move mechanism 170, and consequently exterior shield system 128, into or out of locked position.

Preferably, system 110 further comprises an interior shield system 188 analogous to exterior shield system 128. Interior shield system 188 comprises a plurality of individually translatable interior shield elements 190 analogous to exterior shield elements 130*a*,130*b*,130*c*,130 and disposed on lever arms 172,182 of articulated mechanism 170 such that the linkages in mechanism 170 are shielded during actuation thereof to prevent injury to personnel.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A latch system for sealing a bulkhead door mounted to cover an opening in a bulkhead, comprising:

a) an elongate striker disposed on a surface of said bulkhead door in a direction parallel to an edge of said door, said striker including a wedge portion having constant thickness in said parallel direction and varying thickness in a direction orthogonal to said edge of said door;

b) an elongate locking wedge disposed on said bulkhead adjacent said opening for translation between an open position wherein said elongate locking wedge is clear of said bulkhead door and a lock position wherein said elongate locking wedge overlaps said bulkhead door edge and is engaged with said elongate striker;

c) an exterior shield attached to said locking wedge for covering said locking wedge and said bulkhead door edge when said locking wedge is in said lock position; and d) a first outer surface on said exterior shield and a second outer surface on said striker, wherein said first and second outer surfaces are abutting when said elongate locking wedge is in said lock position.

2. A latch system in accordance with claim 1 wherein said bulkhead door further comprises a resilient gasket and wherein said bulkhead opening is surrounded by a collar extending from said bulkhead and wherein said resilient gasket is in a compressed state against said collar when said locking wedge is in said lock position.

3. A latch system in accordance with claim 1 wherein said striker is continuous along the entirety of said door edge and wherein said elongate locking wedge defines a plurality of locking wedge elements disposed around said bulkhead opening.

4. A latch system in accordance with claim 3 wherein said plurality of locking wedge elements are non-abutting in said open position and are abutting in said closed position to form a continuous frame around said opening and overlapping all of said door edge.

5. A latch system in accordance with claim 4 wherein the number of said locking wedge elements is four.

6. A latch system in accordance with claim 3 further comprising an articulated mechanism attached to said plurality of locking wedge elements for translating said elements between said open position and said lock position and reverse.

7. A latch system in accordance with claim 6 wherein said continuous frame in lock position covers said wedge portion of said elongate striker, said elongate locking wedge, and said articulated mechanism excepting a master actuating lever.

8. A latch system in accordance with claim 6 wherein said articulated mechanism includes a plurality of rotatable spindles disposed in a plurality of bores formed in said bulkhead.

9. A latch system in accordance with claim 8 wherein said mechanism further comprises a plurality of levers, connecting rods, and bellcranks assembled together and connected to said plurality of rotatable spindles for articulation of said mechanism to provide said translating of said plurality of locking wedges.

10. A latch system in accordance with claim 9 wherein a portion of said levers, connecting rods, and bellcranks is disposed on the interior side of said bulkhead.

11. A latch system in accordance with claim 10 further comprising a plurality of interior shield elements attached to said mechanism for translation between said open position and said closed position of said locking wedge elements.

12. A latch system in accordance with claim 1 further comprising:

a) a bulkhead opening;

b) a collar surrounding said bulkhead opening; and c) at least a portion of a lock-actuating mechanism.

13. A vessel comprising:

a) a bulkhead having an opening;

b) a bulkhead door for covering said opening; and c) a latch system including an elongate striker disposed on a surface of said bulkhead door in a direction parallel to an edge of said door, said striker including a wedge portion having constant thickness in said parallel direction and varying thickness in a direction orthogonal to said edge of said door, an elongate locking wedge disposed on said bulkhead adjacent said opening for translation between an open position wherein said elongate locking wedge is clear of said bulkhead door and a lock position wherein said elongate locking wedge overlaps said bulkhead door edge and is engaged with said elongate striker, an exterior shield attached to said locking wedge for covering said locking wedge and said bulkhead door edge when said locking wedge is in said lock position, and a first outer surface on said exterior shield and a second outer surface on said striker and wherein said first and second outer surfaces are abutting when said elongate locking wedge is in said lock position.

14. A vessel in accordance with claim 13 wherein said bulkhead door further comprises a resilient gasket and wherein said bulkhead opening is surrounded by a collar extending from said bulkhead and wherein said resilient gasket is in a compressed state against said collar when said elongate locking wedge is in said lock position.

* * * * *